United States Patent [19]

DiRocco

[11] 4,019,491

[45] Apr. 26, 1977

[54] NO DOWN DRAFT CHIMNEY THROAT

[76] Inventor: Nicholas DiRocco, P.O. Box 3428, Incline, Nev. 89450

[22] Filed: Apr. 7, 1975

[21] Appl. No.: 565,724

[52] U.S. Cl. ..... 126/120; 126/288; 126/307 A

[51] Int. Cl.[2] ..... F24B 1/18

[58] Field of Search ..... 98/119, 58, 79; 126/120, 307 A, 285 R, 121, 129, 131, 288

[56] References Cited

UNITED STATES PATENTS

| | | | |
|---|---|---|---|
| 1,273,695 | 7/1918 | Unsworth | 126/120 |
| 1,755,771 | 4/1930 | Chambers | 126/120 |
| 1,935,751 | 11/1933 | Stuart et al. | 126/121 |
| 2,385,450 | 9/1945 | Koppel | 126/307 A |

FOREIGN PATENTS OR APPLICATIONS

| | | | |
|---|---|---|---|
| 340,078 | 6/1904 | France | 126/120 |
| 4,055 | 2/1904 | United Kingdom | 126/120 |
| 742,363 | 12/1955 | United Kingdom | 126/120 |

*Primary Examiner*—Ronald C. Capossela

*Attorney, Agent, or Firm*—Herbert C. Schulze

[57] ABSTRACT

This is a unique and improved throat for chimneys such as chimneys used in connection with fireplaces which features a complete former damper and throat attached to the sides of the chimney hood portion immediately above the firebox in such manner as to provide a chamber into which downdrafts from the chimney will be directed so as to be diverted back up the chimney and wherein the draft from the firebox or combustion chamber together with smoke will be diverted up the chimney so that if diverted otherwise by downdraft it will enter the air shelf and return up the chimney; the invention is further characterized by the capability of being formed of cardboard or the like in an inexpensive manner which will burn away, and leave the masonry which has been formed thereabout as the final unit; the air shelf is provided with unique cleaning potential through provision of a washing opening.

2 Claims, 4 Drawing Figures

NO DOWN DRAFT CHIMNEY THROAT

CROSS REFERENCE TO RELATED PATENT APPLICATIONS

There are no related patent applications filed by me.

BACKGROUND OF THE INVENTION

1. Field of the Invention

This invention is in the general field of means to prevent downdrafts from chimneys and is more particularly directed to a new, unique, and improved diversion chamber adjacent the chimney throat which is so disposed and shaped as to divert downdrafts from the chimney back up the chimney and so as to eliminate damper lids.

2. Description of the Prior Art

Fireplaces, and the like, which have chimneys, frequently are provided with means to close the chimney against downdrafts which frequently occur, during periods of non-use or use.

Most commonly, such chimneys are closed by means of a "damper lid" which is a sheet of metal or the like used to seal the chimney at its throat.

There is not prior art relating to an air shelf located within a formed damper and adjacent throat which diverts downdrafts back up the chimney and which is never opened nor closed, but always remains in position.

SUMMARY OF THE INVENTION

Fireplaces and the like, in which combustion takes place, are commonly provided with a chimney which may be a pipe or the like. Such chimneys are interconnected to the fireplace or the like by means of a hood resting on or immediately above the firebox and tapering inwardly to appropriately connect with the chimney.

Frequently downdrafts will occur through the chimney of a fireplace, and such occurrences may happen when the combustion chamber is in use or not in use. At such times downdrafts then create drafts throughout the room in which the fireplace or the like is located, and can also cause ashes or the like to be scattered about the room of the fireplace.

It is common practice to install a "damper lid", which is known in the art, in the throat of the chimney which damper lid is used to close the chimney against downdrafts into the firebox when the fireplace is not in use. Such damper lids have a number of disadvantages, chief amongst which are the disadvantages that they usually require a handle or the like which is difficult to operate and located in an awkward position, and very frequently persons using fireplaces forget to open the damper lid upon commencing a fire. This results in smoke from the fire escaping from the fireplace into the room in which it is located rather than dissipating upward through the chimney. It also results in poor draft for the fire in the fireplace resulting in poor combustion thus accentuating the smoke problem.

After considerable study of the characteristics of downdrafts and the characteristics of combustion within a fireplace or the like, I have conceived and developed a new, unique, and improved means for eliminating the problem of downdrafts in fireplaces and the like without the necessity of employing damper lids or the like to close the throat of the chimney.

In accomplishing this new invention, I have fashioned a specially shaped open chamber within the sides of the fireplace hood with an opening left for the drafts involved in combustion and for the carrying of the smoke therefrom between the chamber and adjacent one side of the hood.

When my new device is used, if a downdraft occurs, it is diverted by this improved chamber and is swept backwards up into the chimney. Thus the downdraft never reaches the firebox and thus cannot cause a scattering of debris and ashes located therein.

At the same time, by this unique device, a particularly effective draft passage is created for the proper drawing effect to create excellent combustion and at the same time remove smoke and other products of combustion up the chimney.

I have further formed a very economical and interesting new fireplace hood and air shelf by the utilization of a form of cardboard or the like, which will be described in the description of a preferred embodiment, utilizing an appropriate air shelf held in place by the cardboard form, against which the masonry is then formed. After the masonry is cured, the cardboard or the like may be removed, or may just ultimately be burned away during use of the device. It is understood that it may also be formed of metal or the like, but this very economical means is highly desirable utilizing such a form as cardboard as will be described.

Additionally, I have provided a means for the cleaning of the air shelf and the chimney by utilization of a hose. Under normal cleaning of a chimney there is great difficulty due to soot and the like being forced down into the fireplace and usually getting out into the room. With my invention however the chimney may be washed clean and the water and dirt will be collected within the air shelf and diverted through a special opening provided therein and through the exterior masonry so as to be washable to the exterior of the building.

It is an object of this invention to provide a new and improved means for diverting downdrafts from chimneys back through the chimney.

Another object of this invention is to provide such a means for diverting downdrafts wherein no moving parts nor handles are required for any mechanical operation thereof.

Another object of this invention is to provide an improved fireplace draft device for enhancing combustion.

Another object of this invention is to prevent the causing of a soot blackened front of the fireplace by eliminating the escape of smoke therefrom.

Another object of this invention is to provide a new and unique method of cleaning chimneys by being able to wash the soot into my special draft diverting air shelf.

Another object of this invention is to provide such a means as herein described wherein an economical form of cardboard or the like may be used.

The foregoing and other objects and advantages of this invention will be clear to those skilled in the art upon reading the following description of a preferred embodiment in conjunction with a study of the appended drawings.

DESCRIPTION OF A PREFERRED EMBODIMENT

Figure 1:
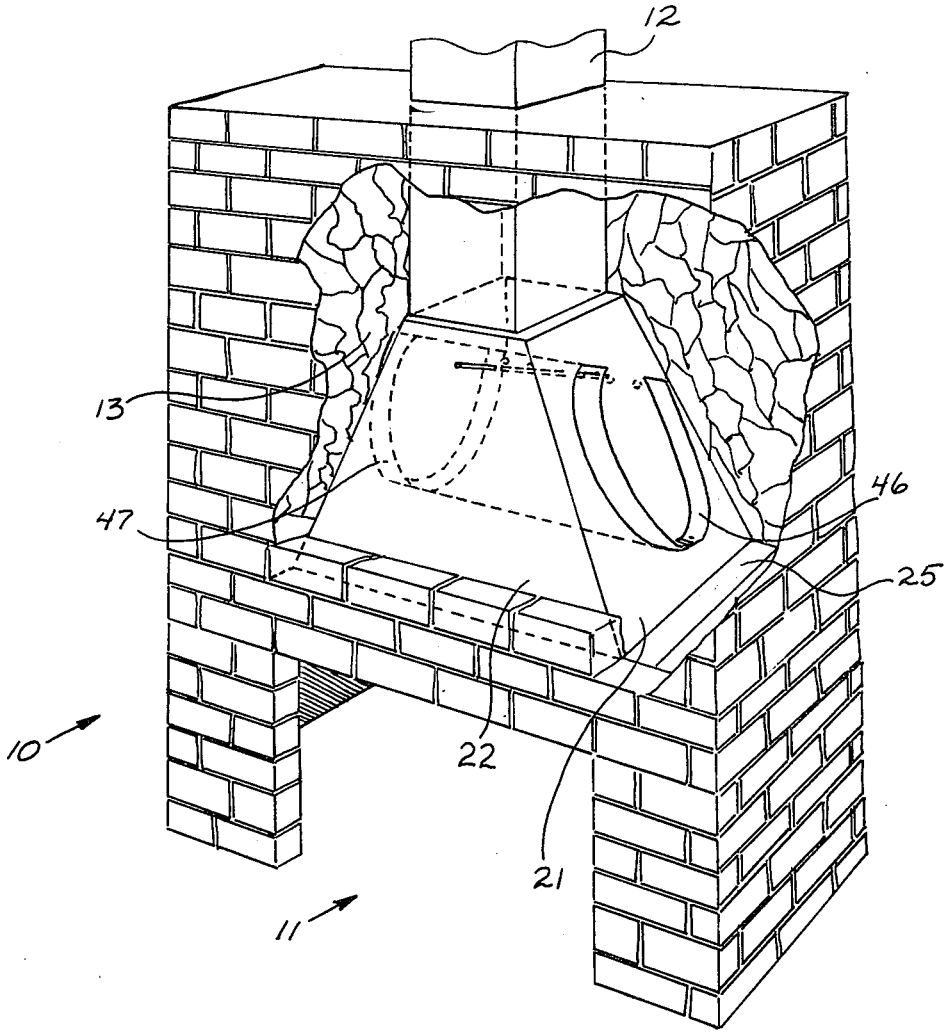
FIG. 1 is a perspective of a fireplace utilizing a preferred embodiment of this invention.

With attention directed to FIG. 1 there is shown a fireplace 10 of more or less customary construction having the opening for the firebox 11 as shown. Masonry or the like 13 is shown within the areas about the hood and flue liner 12.

Certain elements of a preferred embodiment of my invention are shown in FIG. 1 merely for reference since it will be described in more detail below and in conjunction with the other drawings. However, the form sides 21 and 22 are shown, together with the lip 25 which is used for proper placement within the masonry. The edges 46 and 47 of the air shelf are shown as they exist extending into the masonry area of the fireplace.

Figure 2:
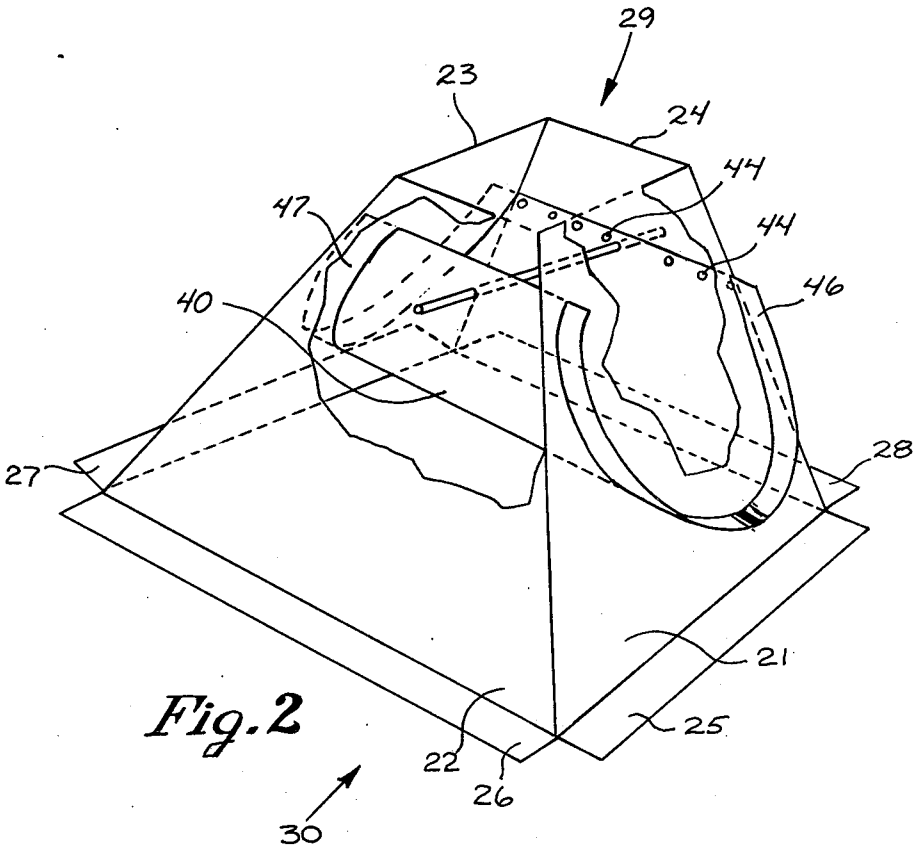
FIG. 2 is a partially broken-away perspective of the invention as utilized in FIG. 1.

Turning attention to FIG. 2 there is seen to exist a hood frame consisting of sides 21, 22, 23 and 24, of which 24 is preferably vertically aligned, being the back of the hood, with the other three sides tapering in as is clear and as is shown in not only FIG. 2, but in the other figures.

Around the bottom edge and as an extension at an angular relationship of each of the sides are the short flanges 25, 26, 27 and 28. These flanges are utilized to locate the device at the appropriate height within the masonry construction during the forming of the balance of the masonry work. An opening of course exists at 29 at the upper portion, and at 30 at the lower portion.

The air shelf 40 is formed of masonry, asbestos cement material, or other appropriate heat resistant material. It is noted that the shape is such that it is fastened at the rear by rivets, bolts, or the like 44 to the back side 24 of the hood frame. The air shelf has been placed in slots in the form sides 21 and 23 as indicated so that a portion 46 and 47 will extend from each end so as to be properly embedible within the masonry during further formation.

A stiffening rod 45 has been provided which extends at an angular relationship from the back of the air shelf to the front of the air shelf at its lip 41, which is seen to be turned slightly inward and extends further so as to be embedded within the masonry. Likewise, the rivets, bolts, or the like 44 will extend beyond the side 24 of the frame so as to also be embedible within the masonry.

A small hole, suitable to accommodate a garden hose or the like 42 will be provided as indicated, and there will also be an opening 43 through the exterior of the building so that the hose opening 42 may accommodate a hose, pipe, or the like through the opening 43.

Figure 3:
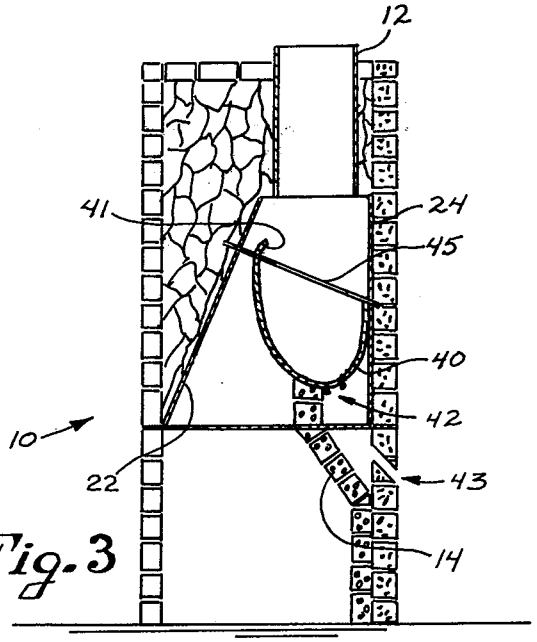
FIG. 3 is a reduced scale section on 3—3 of FIG. 1.

Particular attention to FIG. 3 will show that the lip 41 is so positioned as to provide an opening for draft and smoke at the front of the hood, but in the event draft, water, or the like should come down the chimney it will fall completely within the air shelf 40.

In FIG. 3, which is a section, it is seen that the front 22 and the back 24 of the form are still in position. This would be the condition which would occur immediately after the masonry had been applied. During the application of the masonry, the firewall 14 will also be brought up into contact with the lower portion of the air shelf approximately as shown.

Figure 4:
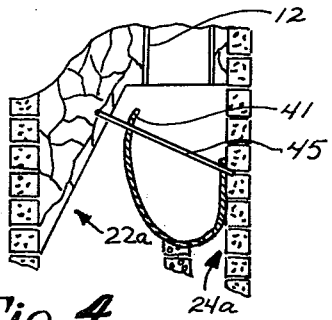
FIG. 4 is a partial view on 3—3 of FIG. 1 wherein the condition is shown after the form utilized has been removed leaving a masonry surface.

In examining FIG. 4 it is seen that the portions of the form 22 and 24 no longer exist, nor will form portions 21 and 23, which are not readily visible in this view. This is the condition after the masonry has set and after the temporary cardboard liner 21, 22, 23 and 24, has been removed or merely burned away by use.

In forming a fireplace of this invention, I shall give some dimensions which will be appropriate dimensions for a proper utilization. The front 22 at its lower portion where it joins the flange 26 will be 36 inches long, the back 24 at its lower edge where it joins its flange 28 will be 27 inches, the sides 21 and 23 at the lower portion where they join their flanges 25 and 27 respectively, will each be 22 inches.

The opening at the top, 29, will be thirteen and one half inches in its dimension parallel to the back 24 and it will join to the back 24. It will be centered on the back 24.

This opening will extend 11½ inches towards the front side 22.

The height of the back will be 30 inches, and the air shelf at the back will be 10 inches below the top and at the front edge of the lip 6 inches below the top. The space between the front and the air shelf front will be 2 inches at the position of the tie-rod 45. The air shelf will terminate approximately 4 inches above the lower edge of the hood form and the lowest portion of the air shelf will be approximately 6 inches from the back 24.

In utilization of this device, when the masonry reaches an appropriate height from the floor, the hood form will be placed in position with the flanges 25, 26, 27 and 28, resting upon the masonry for a distance therein in order to provide support. The masonry then continues against the form, and when it reaches the top, the flue liner is placed in form and the masonry is filled so as to close the opening about the flue liner which will be very close to the size of the opening 29 at the top of the form. Such technique will not be difficult for a skilled mason.

During the masonry construction provisions may be made for a hole 43 through the outer portion of the building in order to accommodate a garden hose or the like which will fit to the centered hole 42 at approximately the location indicated in the drawings.

As previously mentioned, because of the location and configuration of this air shelf, it will be possible to now clean chimneys merely by washing down with water or the like from the top, which water will be caught by the air shelf and then can be diverted through the hole provided and to the exterior of the building.

Additionally, downdrafts will be effectively prevented since they will be diverted by the air shelf and return up the chimney. At the same time full drawing power will be provided for the fireplace at all times so that the smoke will be dissipated up the chimney as desired.

While I have mentioned that the form may be provided from cardboard or the like, for maximum economy and durability, it is to be understood that this device could be constructed of metal or other substances without changing the concept provided.

While the embodiment of this invention shown and described is fully capable of achieving the objects and advantages desired, it will be clear that this embodiment is only for purposes of illustration, and not for purposes of limitation.

I claim:

1. A no down draft chimney throat located beneath a chimney flue comprising: a chimney hood assembly containing no damper lid; and an air shelf consisting of a trough and located within the chimney hood assembly with one side and two ends adhering to said chimney hood assembly and one side not adhering to said chimney hood assembly so as to provide a passage for smoke between the said assembly and said non-adhering side, wherein the non-adhering side edge is positioned outside an imaginary vertical line drawn down the opening of the chimney flue so that water or debris or air coming down the chimney flue will not directly strike the outer edge of said non-adhering side, and wherein the said trough is provided with a cleaning hole adjacent its lower portion, the said cleaning hole being cooperative with another hole located in the outside of the chimney.

2. A no down draft chimney throat located beneath a chimney flue comprising: a chimney hood assembly containing no damper lid, and an air shelf consisting of a trough and located within a chimney hood assembly with one side and two ends adhering to said chimney hood assembly, and one side not adhering to said chimney hood assembly so as to provide a passage for smoke between said chimney hood assembly and said non adhering side, and wherein a trough support rod is provided from the side of the chimney hood assembly adjacent said trough side which is not adhering to said chimney hood assembly to the opposite side of the said chimney hood assembly.

* * * * *